United States Patent [19]

Borgstrom et al.

[11] 4,309,231

[45] Jan. 5, 1982

[54] APPARATUS FOR APPLICATION OF A TAPE OF MATERIAL IN LONGITUDINAL DIRECTION OF A SUBSTANTIALLY RECTANGULAR ELECTRICAL CONDUCTOR

[75] Inventors: Gunnar Borgstrom, Vesteras; Bengt Rothman, Skultuna, both of Sweden

[73] Assignee: ASEA Aktiebolag, Vesteras, Sweden

[21] Appl. No.: 181,655

[22] Filed: Aug. 26, 1980

[30] Foreign Application Priority Data

Sep. 4, 1979 [SE] Sweden ..... 7907341

[51] Int. Cl.[3] ..... H01B 13/26

[52] U.S. Cl. ..... 156/54; 156/201; 156/202; 156/461; 156/463

[58] Field of Search ..... 156/53-54, 156/56, 200-204, 461-467; 493/299-301, 423, 441, 295-296, 302

[56] References Cited

U.S. PATENT DOCUMENTS 3,732,790 5/1973 Miyake et al. ..... 493/302 X

*Primary Examiner*—David A. Simmons

*Attorney, Agent, or Firm*—Watson, Cole, Grindle & Watson

[57] ABSTRACT

A tape of insulating material, provided with a binder, is fixed to an elongated, rectangular electrical conductor in a longitudinal direction thereof, the tape being brought into contact with a first side of the conductor before the other portions of the tape are folded around the conductor with the use of endless belts movable transversely to the longitudinal direction of the conductor for bringing the other portions of the tape in contact with at least two other adjacent sides of the conductor.

4 Claims, 7 Drawing Figures

APPARATUS FOR APPLICATION OF A TAPE OF MATERIAL IN LONGITUDINAL DIRECTION OF A SUBSTANTIALLY RECTANGULAR ELECTRICAL CONDUCTOR

BACKGROUND OF THE INVENTION

This invention relates generally to the application of a tape of insulating material to an elongated, rectangular electrical conductor in a longitudinal direction thereof, the tape being provided with the binder for fixing it to the conductor, and longitudinal portion of the tape being brought into contact with a first side of the conductor before the other portions of the tape are folded around the conductor and fixed thereto. More particularly, the other portions of the tape are folded for contacting them with at least two other adjacent sides of the conductor with the use of endless belts movable transversely of the longitudinal direction of the conductor.

U.S. Pat. No. 4,159,920, commonly owned herewith, discloses a technique for application of a tape of insulating material to an elongated, rectangular electrical conductor in a longitudinal direction thereof, the tape being folded about the conductor. A longitudinal portion of the tape, provided with a binder applied thereto prior to its application to the conductor, is first fixed to one side of the conductor before the other portions of the tape are folded about the adjacent sides of the conductor and fixed thereto by the binder. The fixing of the different portions of the conductor take place by heating the binder upon contact with the pre-heated conductor. Rollers arranged at the sides of the conductor are provided for folding the tape and for holding the folded portions of the tape pressed against the conductor to effectively fix such portions thereto. It is thus made possible, in an efficient and continuous manner, to provide conductors insulated with insulating tape, the insulation of the conductors being free from or substantially free from blisters and having a well-defined predetermined geometry and location on the conductor.

SUMMARY OF THE INVENTION

In accordance with the present invention, a tape of insulating material, provided with a binder, is also applied to an elongated, rectangular electrical conductor in a longitudinal direction thereof, a longitudinal portion of the tape being brought into contact with a first side of the conductor before the other portions of the tape are folded around the conductor and fixed thereto. Moreover, the folding operation is carried out by means of endless belts movable in a direction transversely of the longitudinal direction of the conductor for folding such other portions of the tape into contact with at least two other adjacent sides of the conductor. In such manner, it is possible to effect an efficient stretching of the tape of insulating material about the conductor and especially around the corners of the conductor. This stretching allows the tape to be evenly applied about the conductor, so that the conductor may be bent around mandrels having very small radii without the possibility of breaking the insulating material. Also, application of the tape of insulating material in accordance with the invention permits the folding operation to be carried out at higher speeds by improving upon the damping against vibrations in the conductor, and permits the application to be carried out with equipment having a shorter length than previously required.

The tape of insulating material may be applied directly on the conductor or on a conductor already insulated, for example, with a varnish or polymer film. The varnish may be of a type similar to that normally used when varnishing winding wire, such as, for example, terephthalic acid alkyds, polyester imides, polyamide imides, polyimides, polyurethanes, silicones and epoxy resins. The polymers in the polymer film may, among others consist of a linear, unbranched or branched polymer such as, for example, polyamide imide, polyimide, a polymer based on polyhydantoin, polyethelene glycol terephthalate, polycarbonate and polysulphon. The polymer film may be applied in accordance with the technique of the present invention, such that is applied in the longitudinal direction of the conductor and folded around the edges thereof. It is also possible to spin the film around the conductor. In the latter case at least, another tape of insulating material would then be applied over the polymer film in the longitudinal direction in accordance with the present technique.

In addition to polymer films, other tapes of insulating material which are suitable for application according to the invention may be used, for example, different type of mica tapes, for example, a tape built up of a mixture of small mica flakes ($<5$ mm$^2$) and short fibers of a linear polymer, such as polyamide, of cellulose or glass, or a tape built up only of small mica flakes. Insulating tapes of, for example, paper and woven textile threads, such as cotton threads, or polyamide threads, may also be used for insulation of a conductor according to the present invention. The binder which is applied on the tape of insulating material prior to the application of the tape on the conductor may be of the type required to be heated to be fixed to the conductor but need not be of such type. Examples of suitable binders are flexible polyurethane resins, epoxy resins modified by polyamides, polyesters resins modified by isocyanates, epoxy resins modified by polyurethane resin, and certain rubber types.

Other objects, advantages and novel features of the invention will become more apparent from the following detailed description of the invention when taken in conjunction with the accompanying drawings.

DETAILED DESCRIPTION OF THE INVENTION

Figure 1:
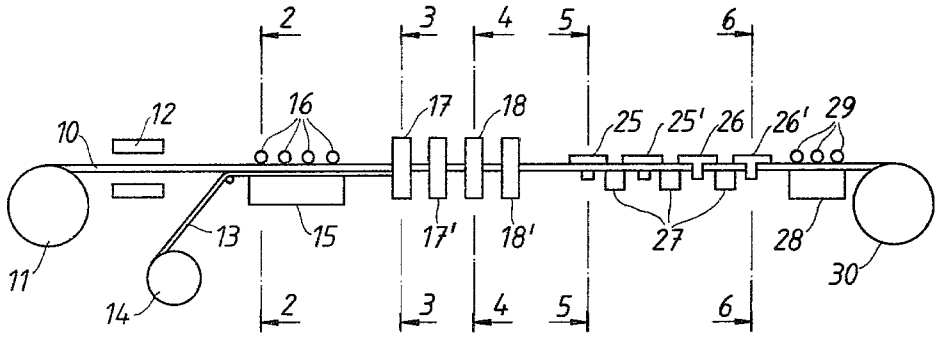
FIG. 1 is a diagramatic side elevational view of an apparatus according to the invention.

Turning now to the drawings wherein like reference characters refer to like and corresponding parts throughout the several views, the apparatus for carrying out the tape applying operation according to the invention is schematically shown in FIG. 1. As similarly described in the aforementioned U.S. Pat. No. 4,159,920, a rectangular copper conductor 10, for example having a width of 8 mm and a thickness of 3 mm, which may be uninsulated or provided with an insulation such as in the form of varnished layer of, for example, terephthalic acid alkyd or in the form of a film of, for example polyamide imide, is conveyed from a storage roller 11 in any normal manner through an induction coil 12, where it is heated to a temperature of around 300° C. An insulating tape 13, for example having a width of 20 mm and a thickness of 75 microns, and made from a mixture of equal parts by weight of small mica flakes and short fibers of an aromatic amide (e.g. NOMEX M from Du Pont, U.S.), is coated on one side with a thin layer of a binder consisting of, for example, a polyamide-modified epoxy resin (such as "AF-42" from Minnesota Mining and Manufacturing Company, U.S.). This tape 13 is conveyed toward the conductor in any normal manner from a storage roller 14 with the binder side of the tape facing the conductor.

Figure 2:
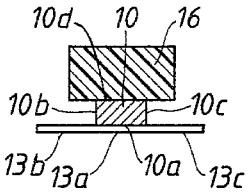
FIGS. 2 to 6 are cross-sectional views of the apparatus for sequentially applying tape to a conductor with the sectional views being taken substantially along lines 2—2, 3—3, 4—4, 5—5, and 6—6, respectively, of FIG. 1.

With reference to FIG. 2, which is essentially the same as the corresponding Figure in the aforementioned patent, a middle portion 13*a* of insulating tape 13 is brought into contact with a first side 10*a* of the conductor and is fixed to that conductor side in a device comprising a plane table 15 and rollers 16 which are held pressed against the upper side of the conductor by means not shown in the drawings. The pressure is effected, as in the case of the rollers described, infra, by spring forces acting on the shafts of the rollers. Rollers 16 may advantageously be made of a plastic which is polytetrafluoro ethylene, possibly surrounded by a shell of metal. Securing of the middle portion 13*a* of tape 13 is obtained because the binder, which is dry from the beginning, melts at the middle portion 13*a* by the heat from the conductor, and then hardens.

Each of the tape portions 13*b* and 13*c* (FIG. 2), extending outwardly of first side 10*a*, is then folded around the edge of the conductor which is located between first side 10*a* and an adjacent side 10*b* and 10*c*, respectively. The folding operation according to the invention, as compared to that shown in the aforementioned patent, is carried out by plurality of devices 17, 17' and 18, 18', comprising endless belts 19 and 20, respectively, suitably of a material having a low coefficient of friction such as polytetrafluoroethylene, which are movable in a direction transversely to the longitudinal direction of the conductor. Each of the devices 17 and 18 further comprise drive rollers 21 and 22, respectively, and deflector rolls 23 and 24, respectively. Belts 19 and 20 are held stretched against the conductor, with insulating tape 13 positioned between the belts and the conductor, by spring forces (not shown) acting on the shafts of the drive rollers (which may be drived in any normal manner). As the insulating tape and the conductor are conveyed through devices 17, 17' it can be seen that belt 19 causes portion 13*b* of the insulating tape to be folded around the conductor with a portion $13b_1$ making contact with side 10*b* of the conductor and with a portion $13b_2$ making contact with side 10*b*.

Figure 3:
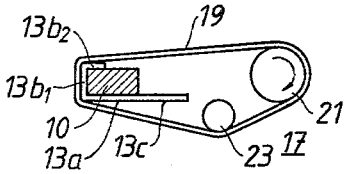
Figure 4:
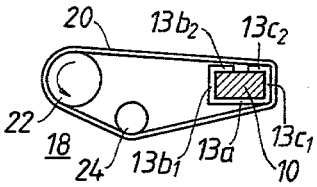
Figure 5:
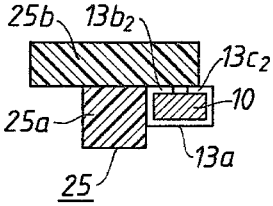
Figure 6:
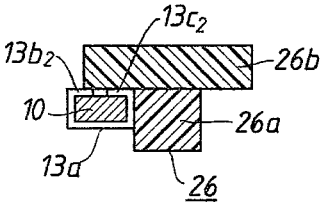

Because of the movement of the belt, in the direction of the arrow of FIG. 3, a stretching of tape portion 13*b* along the conductor is effected during the folding operation. And, as the tape and conductor continue to be conveyed through devices 18, 18', belt 20 effects a folding, in a corresponding manner, of portion 13*c* of the insulating tape so that tape portion $13c_1$ thereof is brought to make contact with side 10*c* of the conductor and portion $13c_2$ thereof is brought to make contact with side 10*d*. In the illustrated example, the folding operation is performed sufficiently rapidly for the binder on the tape not to be able to harden, which allows portions 13*b* and 13*c* to effect a certain amount of sliding movement on a conductor during folding. It can be seen that one of the devices 17 may be employed only to cause portion $13b_2$ to abut side 10*d* on the conductor if portion $13b_1$ prior to this has been brought to abut side 10*d* in another corresponding device, the endless belts of which make an angle with side 10*d* of the conductor.

After being conveyed through devices 17 and 18, the conductor reaches a number of pressure rollers 25, 25' and 26, 26', respectively. Rollers 25 each have a cylindrical portion 25*a*, located outwardly of side 10*b* of the conductor, and a portion 25*b* located outwardly of side 10*d* of the conductor with a surface thereof facing the conductor and lying parallel to side 10*d* thereof. In a corresponding manner, rollers 26 each have a cylindrical portion 26*a* located outwardly of side 10*c* of the conductor, and a portion 26*b* located outwardly of side 10*d* of the conductor with a surface thereof facing the conductor and lying parallel to side 10*d*. Rollers 25 and 26, which may advantageously be made of polytetrafluoro ethylene, are maintained pressed against sides 10*b*, 10*d* and 10*c*, 10*d*, respectively, of the conductor by spring force (not shown). A number of supports 27 are disposed beneath rollers 25 and 26 for acting as a support means against the downwardly-directed pressure of the rollers on the conductor. Rollers 25 and 26 ensure an efficient contact of insulating materials portions $13b_1$, $13b_2$ and $13c_1$, $13c_2$, respectively, along their entire contact surfaces with the conductor in connection with such portions of the insulating tape being fixed to the adjacent conductor sides by the hardening of the binder. However, it should be pointed out that, if the securing of these portions of the tape of insulating material takes place after passing through devices 17 and 18, rollers 25 and 26 may be eliminated. The conductor with the applied tape finally passes over a plane table 28 and beneath a number of rollers 29 of the same type as rollers 16 before it is wound up on a wind-up device 30.

Figure 7:
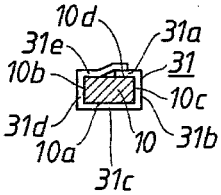
FIG. 7 is sectional view of a conductor having a tape applied thereon with its ends overlapping.

FIG. 7 shows the application of a wider tape 31 than tape 13 onto conductor 10 utilizing the invention. For example, portion 31*a* of the tape may be fixed in place similarly as described with reference to portion 13*a* of tape 13, after which portions 31*b* and 31*c* may be folded with a device such as 18, after which portions 31*b* and 31*e* may be folded with a device such as 17. Thus, all the portions 31*b-e* are folded with the devices according to the invention, the endless belts of which are moved clockwise along the surfaces of the conductor.

Obviously, many modifications and variations of the present invention are made possible in the light of the above teachings. For example, the use of a binder on the tape of insulating material is herein disclosed which fixes the tape to the conductor by being heated by the conductor. The invention also contemplates use of a binder by which the fixing to the conductor may be effected at room temperature. It is there to be understood that within the scope of the appended claims the invention may be practiced otherwise than as specifically described.

What is claimed is:

1. Method of applying a tape of insulating material to an elongated, rectangular electrical conductor in a longitudinal direction thereof, the tape being provided with a binder for fixing it to the conductor, and a longitudinal portion of the tape being brought into contact with a first side of the conductor before the other portions of the tape are folded around the conductor and fixed thereto, the improvement comprising the steps of:

providing movable endless belts at successive operating stations for folding said other tape portions around the conductor;

moving said belts at said stations transversely of the longitudinal direction of the conductor for successively contacting the respective other portions of the tape with at least two other adjacent sides of the conductor; and conveying the conductor and the tape through said operating stations.

2. The method according to claim 1, comprising the further step of pressing said other portions of the tape against said two other adjacent sides of the conductor following said moving step.

3. An apparatus for application of a tape of insulating material provided with a binder, to an elongated, rectangular electrical conductor in longitudinal direction thereof at a series of successively positioned operating stations, comprising:

a device at one of the stations for fixing only a longitudinal portion of the tape to a first side of the conductor; and endless belts at succeeding ones of the stations movable transversely to the longitudinal direction of the conductor for folding the other portions of the tape about at least two other adjacent sides of the conductor.

4. The apparatus according to claim 3, further comprising at least one device at a further succeeding operating station for pressing said other portions of the tape on to the conductor after being folded therearound by said belts.

* * * * *